United States Patent [19]

Dempsey et al.

[11] Patent Number: 4,962,749

[45] Date of Patent: Oct. 16, 1990

[54] METHOD OF OPERATING A NATURAL GAS FURNACE WITH PROPANE

[75] Inventors: Daniel J. Dempsey, Carmel; Kevin D. Thompson, Indianapolis, both of Ind.

[73] Assignee: Carrier Corporation, Syracuse, N.Y.

[21] Appl. No.: 435,904

[22] Filed: Nov. 13, 1989

[51] Int. Cl.[5] ..... F24H 3/00

[52] U.S. Cl. ..... 126/116 A; 236/15 BD; 431/2; 237/53; 126/110 E; 126/110 R; 126/99 R

[58] Field of Search ..... 126/116 A, 116 R, 110 E, 126/110 R, 99 R; 431/11, 2; 237/2 A, 53, 55; 236/10, 11, 15 BA, 15 BD, 15 E; 165/1, 13, 32

[56] References Cited

U.S. PATENT DOCUMENTS

| | | | |
|---|---|---|---|
| 4,421,268 | 12/1983 | Bassett | 236/91 F |
| 4,519,540 | 5/1985 | Boulle et al. | 236/15 BD X |
| 4,575,663 | 3/1986 | Papson et al. | 318/445 |
| 4,576,570 | 3/1986 | Adams et al. | 236/15 BD |
| 4,640,674 | 2/1987 | Kitchen | 431/1 |
| 4,676,734 | 6/1987 | Foley | 236/15 BD |
| 4,688,547 | 8/1987 | Ballard et al. | 126/116 A |
| 4,690,636 | 9/1987 | Lemonnier de Gouville et al. | 126/39 E X |
| 4,706,881 | 11/1987 | Ballard | 236/15 BD |
| 4,729,207 | 3/1988 | Dempsey et al. | 126/116 A X |
| 4,770,627 | 9/1988 | Yoshino | 236/15 BD X |
| 4,792,089 | 12/1988 | Ballard | 431/78 |
| 4,895,082 | 1/1990 | Mindermann et al. | 236/15 E X |

FOREIGN PATENT DOCUMENTS

| | | | |
|---|---|---|---|
| 14014 | 1/1985 | Japan | 236/15 BD |

*Primary Examiner*—Larry Jones

*Attorney, Agent, or Firm*—Dana F. Bigelow

[57] ABSTRACT

In a gas furnace designed for operation with natural gas, the use of propane as a fuel is facilitated by increasing the inducer speed by a factor which is obtained by comparing the higher inducer speed necessary to bring down the heat exchanger temperature to an acceptable level, with the original lower inducer speed that had caused the temperature to exceed the allowed limit. Provision is made for electronically applying the multiplying factor by simply operating a gas selector switch.

6 Claims, 2 Drawing Sheets

METHOD OF OPERATING A NATURAL GAS FURNACE WITH PROPANE

This invention relates generally to furnaces, and more particularly to a method of using propane in a furnace designed for use with natural gas.

BACKGROUND OF THE INVENTION

In the design of a gas fired furnace it is necessary to establish for each mode of operation (e.g. high and low fire conditions) the proper mixture of fuel and combustion air so as to optimize the efficiency of the combustion process. This is normally accomplished by establishing a given gas input rate for each stage of the burner and then establishing an appropriate speed of the draft-inducer motor in order to maintain the desired level of excess air for the combustion process. Such a method and apparatus is shown and described for an induced draft, two stage gas fired furnace in U.S. Pat. No. 4,703,747 issued on Nov. 3, 1987 and assigned to the assignee of the present invention.

If propane is used as the fuel in such a furnace designed for natural gas operation, there are certain standard hardware changes that are commonly made (i.e., smaller gas manifold orifices and a different gas valve or regulator spring to change the manifold pressure. Still, it is recognized that with the same flow rate (i.e., BTU/HR), the furnace will tend to operate at higher temperatures due to higher flame temperatures within the heat exchanger. If no other changes are made to the furnace, those operating temperatures could be excessive, particularly in the area of the heat exchangers. In systems originally designed for use with propane, the temperatures of propane can be taken into account in establishing the material requirements and operating capabilities of the system. However, if one wishes to merely substitute the use of propane in a natural gas furnace without changing associated components such as limit switches, pressure switches, etc., there are few alternatives.

The more obvious approaches are to either reduce the gas input rate or increase the speed of the circulating air blower when using propane gas. Such changes to the system are undesirable because the temperature rise of the unit could drop out of the allowable range, and specifying a new rise range for a propane conversion is impractical. In addition, such changes may adversely affect limit switch performance, condensate dwell performance, and air distribution characteristics.

It is therefore, an object of the present invention to provide an improved method for the use of propane in a furnace designed for the use of natural gas.

Another object of the present invention is the provision in a gas fired furnace designed for use with gas, for using propane without de-rating the input of the system.

Yet another object of present invention is the provision in a gas fired furnace designed for use with natural gas, for using propane without changing the temperature rise range.

Still another object of the present invention is the provision for converting, in a practical and efficient manner, and without structural changes other than gas manifold orifices, a gas fired furnace designed for natural gas use to one using propane.

The objects and advantages become more readily apparent upon reference of the following description when taken in conjunction with the appended drawings.

SUMMARY OF THE INVENTION

Briefly, in accordance with one aspect of the invention, a gas fired furnace designed for operation with natural gas is made to operate with propane by increasing the speed of the inducer motor to thereby proportionately increase the excess air and reduce the temperature of the combustion gases such that the resulting temperature in the heat exchanger is brought down to an acceptable level. In this way, no significant structural change is required of the furnace, and the system requires neither a gas input de-rating nor a changing of the temperature-rise range.

By yet another aspect of the invention, the operational parameters for use with propane are found by first operating the system with propane and with the existing natural gas parameters while determining what the resulting elevated heat exchanger temperatures are. The operation of the inducer motor is then placed in manual control, and while monitoring the temperature of the heat exchanger, the inducer motor speed is increased until the heat exchanger temperature is reduced to an acceptable level, at which time the inducer motor speed is recorded. The recorded speed is then compared with the normal speed for natural gas use in that mode to obtain a multiplier which is subsequently used in the existing natural gas equations to obtain the slightly higher speed of operation for the inducer motor.

By yet another aspect of the invention, the only change that is required to convert from a furnace from natural gas use to propane use is to select, by way of an appropriate selection switch, the use of an appropriate multiplier to be applied to each of the equations applicable to the control of the inducer motor in its various states of operation.

In the drawings as hereinafter described, a preferred embodiment is depicted. However, various other modifications and/or alternate constructions can be made thereto without departing from the true spirit and scope of the invention.

DESCRIPTION OF THE PREFERRED EMBODIMENT

Figure 3:
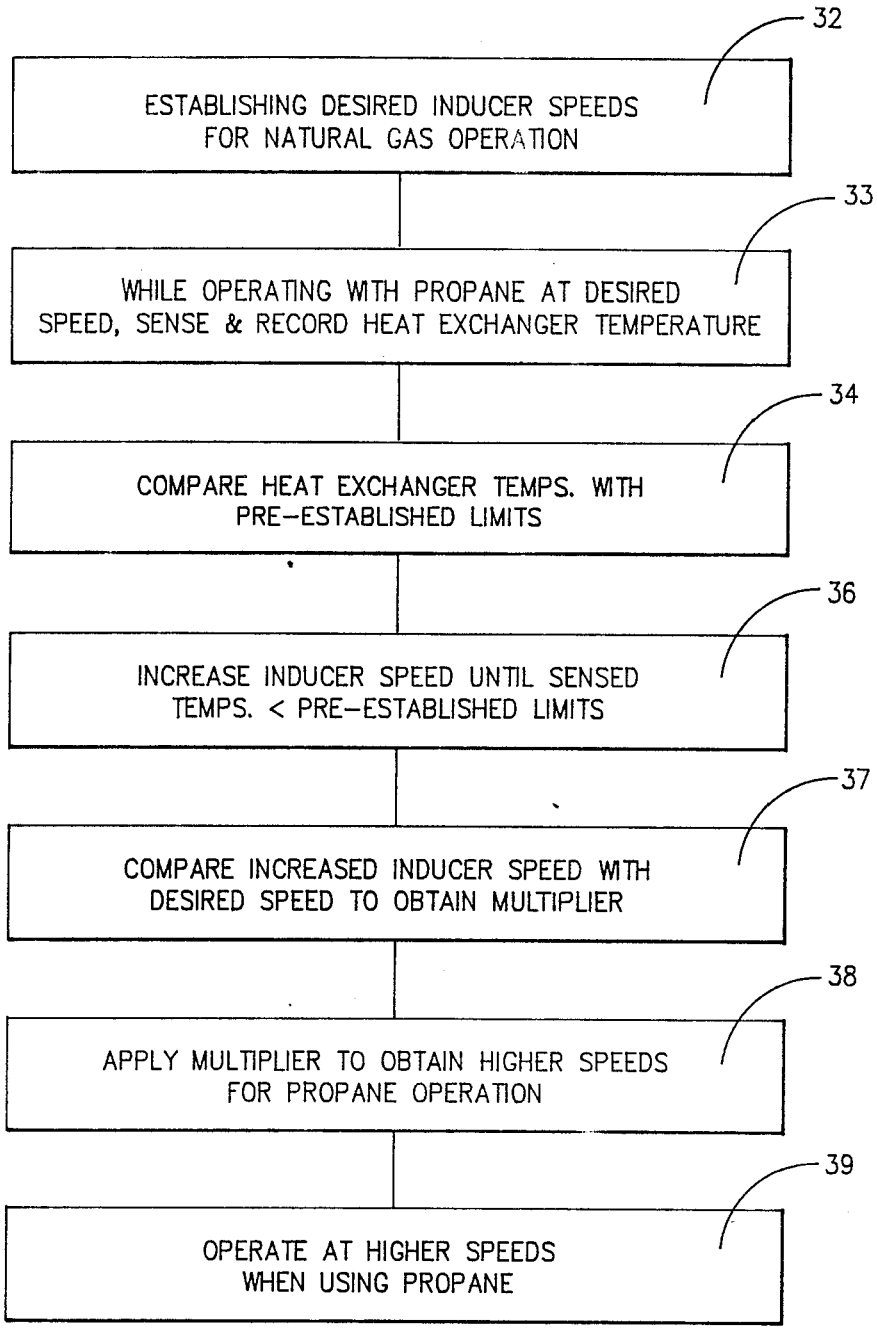
FIG. 3 is a flow chart showing the method of the present invention.

The present invention is intended for use in a gas furnace of the type shown and described in U.S. Pat. No. 4,703,747 issued on Nov. 3, 1987 and assigned to the assignee of the present invention. That patent is incorporated herein by reference. The furnace described in the above referenced patent was designed for use with natural gas and, in order to obtain efficient operation in various operating modes, the excess air is controlled by establishing predetermined levels of speeds for the inducer motor in accordance with the Equations (3)(6)and FIGS. 3–5 of that reference.

In order that the same apparatus could be used with propane, with its inherently higher operating temperatures, and without (1) exceeding the predetermined temperature limit in the heat exchanger, (2) increasing the speed of the circulating air blower or (3) reducing the gas input rate, it was recognized by the applicants that this could be accomplished by increasing the excess air so as to thereby cool the temperatures in the heat exchanger. It was therefore necessary to determine how much the excess air had to be increased and to thereby determine a factor which could be used in the operating algorithms to obtain the desired results.

Figure 1:
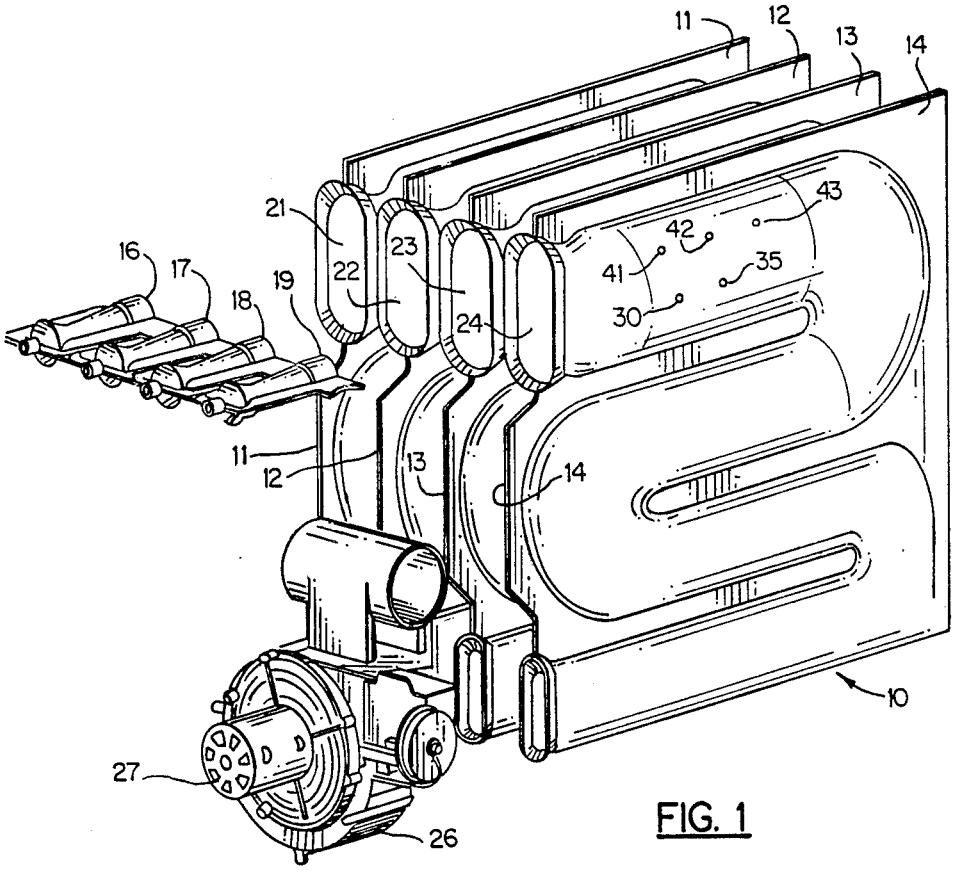
FIG. 1 is a perspective view of the heat exchanger portion of the test apparatus used to derive data in support of the present invention.

Referring now to FIG. 1, there is shown a heat exchanger assembly 10 that was used in the operation of a furnace, such as that shown and described in the above mentioned reference, for obtaining the necessary data for purposes of this derivation. The heat exchanger assembly 10 comprises a plurality of 4-pass heat exchanger cells, indicated at 11, 12, 13 and 14, disposed in parallel relationship with respective burners 16, 17, 18 and 19, disposed at the respective inlets 21, 22, 23 and 24. At the discharge ends of the heat exchanger cells 11, 12, 13 and 14, a common discharge plenum (not shown) is fluidly connected to an inducer 26 which draws the combustion gasses through the heat exchanger cells 11, 12, 13 and 14, to be discharged from an exhaust vent (not shown) in a conventional manner. The draft inducer 26 is driven by a motor 27 in response to control signals from a microprocessor in the manner described in the above referenced patent.

Recognizing that the temperatures in the heat exchanger, and in particular those temperatures in the first leg of the 4-pass heat exchanger where the combustion occurs, are limited by its ability to withstand higher temperatures occasioned by the use of propane, thermocouples were attached to each side of each of the cells 11, 12, 13 and 14, for the purpose of measuring operational temperatures at those locations.

While only five thermocouples, i.e., 30, 35, 41, 42 and 43, are shown on the right side of cell 14, it should be understood that thermocouples are also placed, in corresponding locations, at the left side (i.e., the inner side) of cell 14, as well as on the left and right sides of cells 11, 12 and 13. The system was then operated with use of propane in the burners 16, 17, 18 and 19, with the inducer motor operating at 2480 rpm, (i.e., the desired speed for high fire, minimum vent operation), resulting in a heat exchanger pressure drop of 0.71 inches w.c. The resulting baseline data that was obtained from the thermocouples, minus the maximum allowable temperature limit, is tabulated in column 4 of the table set forth below.

| HEAT EXCHANGER CELL NO. | LEFT/ RIGHT | THERMO-COUPLE | (CELL TEMPERATURE - MAX LIMIT) DEGREE F. | | | |
|---|---|---|---|---|---|---|
| | | | .71 | .73 | .78 | HXDP |
| | | | 2480 | 2515 | 2593 | RPM |
| 11 | L | 42 | −61 | −73 | −78 | |
| 11 | L | 43 | −63 | −67 | −88 | |
| 11 | R | 35 | −58 | −88 | −79 | |
| 11 | R | 41 | −37 | −67 | −56 | |
| 11 | R | 42 | +20 | +1 | −2 | |
| 12 | L | 35 | −45 | =58 | −64 | |
| 12 | L | 42 | −16 | −31 | −37 | |
| 12 | L | 43 | −12 | −26 | −37 | |
| 12 | R | 43 | −99 | −117 | −13 | |
| 13 | L | 41 | −59 | −46 | −89 | |
| 13 | R | 35 | −74 | −78 | −97 | |
| 13 | R | 41 | −66 | −14 | −88 | |
| 13 | R | 42 | −26 | +23 | −50 | |
| 14 | L | 30 | −84 | −89 | −108 | |
| 14 | L | 35 | −40 | −47 | −62 | |
| 14 | L | 41 | −27 | −21 | −51 | |
| 14 | L | 42 | +22 | +11 | −2 | |
| 14 | R | 41 | −85 | −87 | −111 | |
| 14 | R | 42 | −51 | −66 | −77 | |

It was recognized that in two of the thermocouple locations, (i.e., thermocouple 42 on the right side of cell 11 and thermocouple 42 on the left side of cell 14) the temperature exceeded the maximum allowable temperature by 20° F. and 22° F., respectively.

The inducer motor speed was then increased to 2515 rpm to produce a pressure drop of 0.73 inches w.c. The resulting data which was obtained is shown in column 5 of the above table. It was recognized that thermocouple 42 on the right side of cell 11 was still above the limit as was the temperature at thermocouple 42 on the left side of cell 14. In addition, the temperature at thermocouple 42 on the right side of cell 13 also exceeded the maximum allowable temperature by 23° F. Additional excess air was therefore required.

The speed of the inducer motor 27 was then again increased to 2593 rpm to bring about a heat exchanger pressure drop of 0.78 inches w.c. The resulting temperatures were now all below the maximum temperature limit, indicating that this speed was appropriate for operation with propane as the fuel of choice.

In order to relate the inducer speed of the corresponding acceptable temperatures to that of the standard speed with unacceptably higher temperatures, the following equation was derived:

$$\frac{2593 \text{ rpm}}{2480 \text{ rpm}} = 1.05 \qquad \text{Eq. (1)}$$

This, is then the multiplier which must be applied to each of the inducer speeds set forth in the equations of the above referenced patent. This process is accomplished by way of the circuit shown in FIG. 2.

Figure 2:
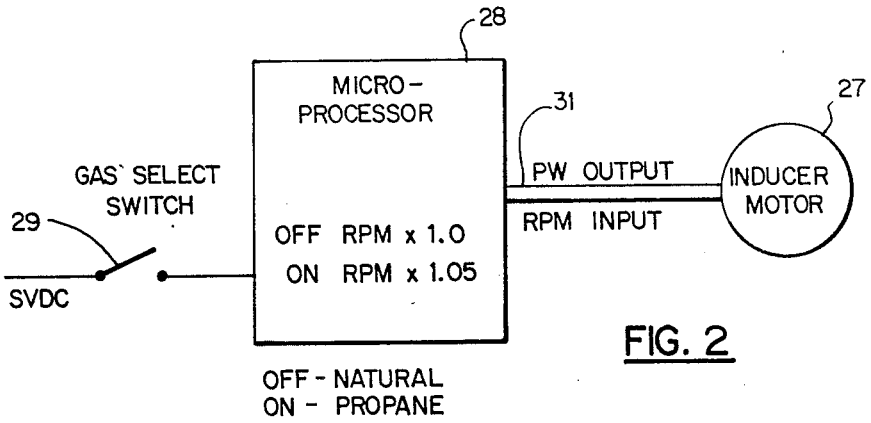
FIG. 2 is the multiplier circuit portion of the present invention.

The microprocessor for the furnace of the present invention, includes a functional portion represented by the block 28 in FIG. 2. If the gas select switch 29 is left open, as would be the case with the use of natural gas, then the microprocessor block 28 would simply multiply the requested inducer motor speed by 1 such that it would be the same as set forth in those equations of the above mentioned patent. On the other hand, if propane is used, the gas select switch 29 is closed and the microprocessor block 28 applies a multiplier of 1.05, with the result being passed along lines 31 to the inducer motor so as to thereby increase the motor speed by that factor. In this way, the percentage of excess air is increased and the heat exchanger temperatures remain within the allowable limit.

The process of the present invention can therefore be summarized as follows. After establishing the desired inducer speeds (See Block 32 in FIG. 3) that are appropriate for natural gas operation (i.e., as set forth in the above referenced patent), the system is operated at a desired speed with propane being used as the fuel. The heat exchanger temperatures are sensed and recorded at that speed (Block 33) and compared with a pre-established heat exchanger temperature limit (Block 34). The inducer speed is then increased until the sensed heat exchanger temperatures are below the pre-established temperature limit (Block 36). The resulting speed is then sensed and recorded and compared with the original desired speed in order to obtain a multiplier (Block 37), which is then applied to the desired inducer speeds established in block 32 to obtain the desired higher speeds for propane operation (Block 38). The system is then operated at those higher speeds whenever propane is being used as the fuel (Block 39).

While the present invention has been disclosed with particular reference to a preferred embodiment thereof, the concepts of this invention are readily adaptable to other embodiments, and those skilled in the art may vary the structure or method thereof without departing from the essential spirit of the present invention.

What is claimed is:

1. A method of using propane at a predetermined input rate in a burner of a furnace of the type designed for operation with natural gas at the same gas input rate and with a heat exchanger having a predetermined temperature limit and having its combustion air supply level controlled by selective regulation of the draft inducer motor speed, comprising the steps of:

establishing the desired draft inducer motor speed when natural gas is used in the burner;

applying to said desired speed a predetermined multiplier to obtain slightly higher speed and excess air levels for combustion; and operating said draft inducer motor at said slightly higher speed when using propane in the furnace to thereby maintain the temperature in the heat exchanger below the predetermined temperature limit.

2. A method as set forth in claim 1 wherein said furnace includes microprocessor control and wherein said predetermined multiplier is applied to said microprocessor control.

3. A method as set forth in claim 1 wherein said predetermined multiplier is 1.05.

4. A method of controlling the temperature in the heat exchanger of a furnace designed for use with natural gas when using propane, comprising the steps of:

operating the furnace with propane and with the inducer motor operating at a predetermined first speed commensurate with the use of natural gas at the same gas input rate while allowing the temperature of the heat exchanger to rise above a predetermined limit;

while maintaining the same gas input rate, increasing the speed of the inducer motor so as to thereby increase the excess air and decrease the temperature in the heat exchanger until it is below said predetermined limit;

sensing and recording the speed of the inducer motor when the heat exchanger temperature drops below said temperature limit;

comparing said recorded inducer motor speed with said first predetermined motor speed to obtain a multiplier; and applying said multiplier to said predetermined speed and operating the inducer motor to proportionally increase said inducer motor speed when the system is operating with propane.

5. A method as set forth in claim 4 wherein said furnace includes a microprocessor and further wherein said multiplier is applied to said microprocessor.

6. A method as set forth in claim 4 wherein said multiplier is 1.05.

* * * * *